United States Patent [19]

Focke et al.

[11] Patent Number: 4,973,008

[45] Date of Patent: Nov. 27, 1990

[54] PACKAGING MACHINE FOR THE PRODUCTION OF CIGARETTE PACKS

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 292,160

[22] Filed: Dec. 30, 1988

[30] Foreign Application Priority Data

Jan. 4, 1988 [DE] Fed. Rep. of Germany ..... 3800029

[51] Int. Cl.[5] ..... B65H 19/12

[52] U.S. Cl. ..... 242/58.6; 414/911

[58] Field of Search ..... 242/58–58.6, 242/79; 414/911, 267, 277

[56] References Cited

U.S. PATENT DOCUMENTS

| | | | |
|---|---|---|---|
| 3,424,394 | 1/1969 | Moore | 242/58.6 |
| 4,441,662 | 4/1984 | Seragnoli | 242/58.6 X |
| 4,543,149 | 9/1985 | Abe et al. | 242/58.6 X |
| 4,589,811 | 5/1986 | Riccardo | 242/58.6 X |
| 4,597,316 | 7/1986 | Ichikawa | 242/58 X |
| 4,614,075 | 9/1986 | Focke et al. | 242/58 X |
| 4,718,813 | 1/1988 | Kehlenbach | 414/911 X |
| 4,798,349 | 1/1989 | Manservisi | 242/58.6 X |

FOREIGN PATENT DOCUMENTS

| | | |
|---|---|---|
| 0144009 | 6/1985 | European Pat. Off. . |
| 0155863 | 9/1985 | European Pat. Off. . |
| 0269807 | 6/1988 | European Pat. Off. . |
| 1532203 | 1/1970 | Fed. Rep. of Germany . |
| 2362485 | 6/1975 | Fed. Rep. of Germany . |
| 3342204 | 5/1985 | Fed. Rep. of Germany . |
| 3501813 | 7/1985 | Fed. Rep. of Germany . |
| 3402582 | 8/1985 | Fed. Rep. of Germany . |
| 60-44444 | 3/1985 | Japan . |
| 2093439 | 9/1982 | United Kingdom . |
| 2106875 | 4/1983 | United Kingdom . |
| 8101946 | 7/1981 | World Int. Prop. O. . |

*Primary Examiner*—John M. Jillions

*Attorney, Agent, or Firm*—Sughrue, Mion, Zinn, Macpeak & Seas

[57] ABSTRACT

High-performance packaging machines have a large consumption of packaging material. When blanks are produced in the region of the packaging machine by being severed from a material web wound as a reel, such reels have to be supplied to the packaging machine in sufficient quantity, specifically for reception by a rotatable supporting journal (16) located on the machine.

For the efficient labor-saving supply of reels (12, 13, 14, 15) to the packing machine, a plurality of these are arranged on a movable supporting frame (19) in such a way that, by bringing the supporting frame (19) up to the transversely projecting supporting journal (16), the particular leading reel (12, 13, etc.) can be pushed onto the supporting journal (16). At the same time, the supporting journal (16) can be moved up and down between a receiving position and a working position. The feed of the reels (12, 13, etc.) is especially suitable for producing blanks from thin cardboard by tearing them off from the material web (10).

16 Claims, 8 Drawing Sheets

PACKAGING MACHINE FOR THE PRODUCTION OF CIGARETTE PACKS

BACKGROUND OF THE INVENTION

The invention relates to a packaging machine, especially for the production of cigarette packs, in which pack blanks are severed from a material web wound as a reel and are processed, one reel at a time being received on a rotatable supporting journal.

Packaging machines for small packs, for example for cigarette packs, are often designed with the aim of producing pack blanks immediately before packaging by severing a material web within the packaging machine. Recently, a way has also been found in the production of packs from thin cardboard, namely hinge-lid packs of forming the blanks by severing them from a material web in the region of the packaging machine (German Patent Application No. P 37 16 897.5). The productive capacity of the packaging machines on the one hand and the greater material thickness of the blanks in the abovementioned types of pack require larger reels and at the same time solutions for achieving an efficient follow-up of packaging material.

SUMMARY OF THE INVENTION

The object on which the invention is based is to design and develop further a packaging machine, especially for cigarette packs, in such a way that large-volume reels for the production of pack blanks can be fed to the packaging machine in a simple way and brought into a necessary working position, without involving attendance staff.

To achieve this object, the packaging machine according to the invention is characterized in that several reels, arranged equiaxially next to one another on supporting frame, can be fed to the supporting journal in succession, and the particular leading reel can be attached to the supporting journal.

The supporting journal for the (working) reel running off is appropriately arranged at the rear of the packaging machine, so that the reels can be advanced to the transversely projecting supporting journal in the direction of the latter. For this, according to the invention, there is a supporting frame which is movable on rollers and on which the reels are arranged equiaxially in parallel alignment. The supporting frame consists of a baseplate with a carrying trough for the reels and preferably of a rear wall for supporting the particular trailing reel located at the rear. The reels are appropriately anchored releasably to the supporting frame, so that the relative position of the reels is not changed during the transport of the supporting frames from a loading station to the packaging machine.

According to a further proposal of the invention, the reels are arranged on a reel core (core tube) which is of special design, in particular which can be divided in the radial direction. It is thereby possible, when a reel has run empty, to draw the core tube transversely from the supporting journal in parts.

According to the invention, the supporting journal is vertically adjustable, preferably by being arranged on a pivotable supporting arm. The supporting journal can thereby be lowered level with the reel to be received and the latter can then be pushed on. In order to draw off the material web, the supporting journal is moved back to a working height.

Further features of the invention relate to the design of the supporting frame for the reels and to details of the packaging machine.

An exemplary embodiment of the invention is explained in detail below with reference to the drawings, in which:

DETAILED DESCRIPTION OF A PREFERRED EMBODIMENT

The question here is the supply of packaging machines with packaging material which is provided as a material web 10 for producing individual blanks 11 in the region of the packaging machine. The material web 10 is delivered as a wound reel 12, 13, 14, 15. These are relatively bulky and therefore have a high dead weight. The material web 10 is drawn off from a particular working reel which for this purpose is attached to a freely projecting rotatable supporting journal 16.

Figure 1:
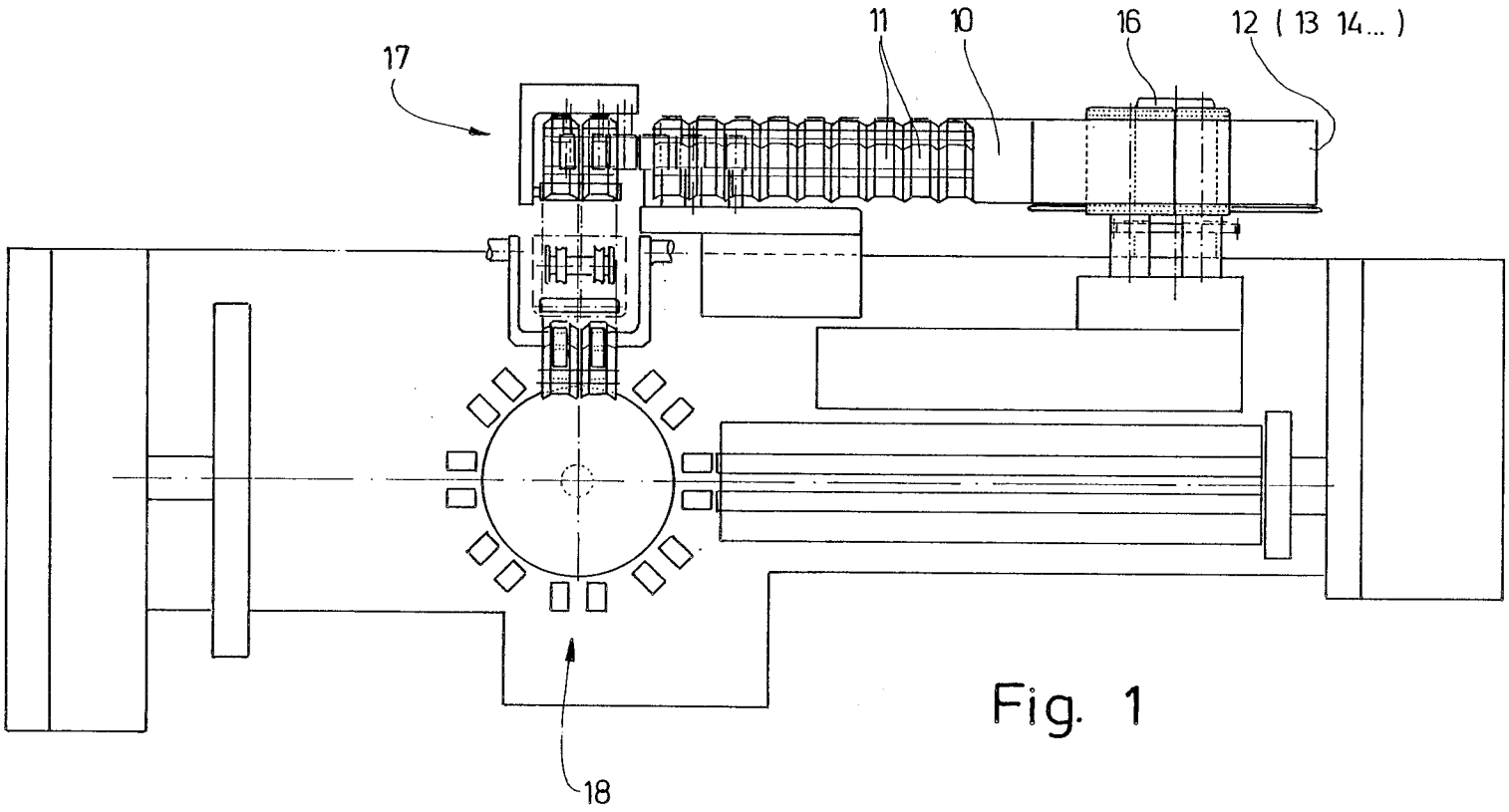
FIG. 1 shows a diagrammatic plan view of a packaging machine.

The present exemplary embodiment of a packaging machine (FIG. 1) is concerned with the production of hinge-lid packs for cigarettes. For this, the packaging material is thin cardboard. The blanks 11 are produced by being torn off from the material web 10. The procedure for this is appropriately as illustrated and described in German Patent Applications Nos. P 37 35 675.5 and P 37 35 674.7.

Accordingly, in the present exemplary embodiment, the supporting journal 16 is arranged at the rear of the packaging machine and is directed transversely relative to the longitudinal extension of the latter. The material web 10 is drawn off from the working reel 12, 13, etc. parallel to a longitudinal plane of the packaging machine and is divided into individual blanks 11 in the region of a severing station 17. In the present exemplary embodiment (FIG. 1), a dual web mode of operation is provided. Two blanks 11 located next to one another are therefore conveyed simultaneously to a folding turret 18 of the packaging machine.

In order to supply the packaging machine with packaging material, several reels, in this particular case four reels 12, 13, 14, 15, are fed to the packaging machine on a supporting frame 19. In the present exemplary embodiment, the supporting frame 19 is moved towards the rear side of the packaging machine, in particular up to the supporting journal 16.

In the present exemplary embodiment, the supporting frame 19 consists of a baseplate 20 with a storage trough 21 extending in the longitudinal direction. The cross-section of this is such that the cylindrical reels 12, 13, etc. are received in the storage trough 21 with their peripheral surface fitting into it and thus rest firmly on the supporting frame 19.

On the front side, facing the supporting journal 16, the supporting frame 19 or the storage trough 21 is open. As a result, the particular leading reel 12, 13, etc. can be pushed onto the projecting supporting journal 16 directly by means of the transport movement of the supporting frame 19. In proportion to the consumption of material by drawing off the material web 10 from the particular working reel, the reels 12, 13, etc. are gradually transferred to the supporting journal 16 from the supporting frame 19. At the same time, the relative position of the particular remaining reels 13, 14, etc. on the supporting frame 19 remains unchanged. During the advancing movement or during the pushing of a reel onto the supporting journal 16, the supporting frame 19 is pushed partially under the packaging machine.

On the rear side, facing away from the supporting journal 16, the supporting frame 19 is equipped with a vertical rear wall 22. The particular reel 15 located at the rear is supported on this.

The reels 12, 13, etc. are conventionally equipped with a central orifice 23 which makes it possible for them to be attached to the supporting journal 16. In the exemplary embodiment illustrated, the reels 12, 13 are wound onto a core tube 24. By means of this, the reels 12, 13, etc. are pushed onto the supporting journal 16. Arranged in the region of the supporting frame 19 between the reels 12, 13, etc. are spacer rings 25 which consist, for example, of plastic and which have an angular profile. The spacer rings 25 penetrate into the core tube 24 by means of a centering flange 26 and lie between the adjacent core tubes 24 to form a clearance between the reels 12, 13, etc. These can therefore be extracted in succession faultlessly. Even during transport, the danger of damage to side edges and side corners of the blanks 11 within the prepunched material web 10 is prevented. A spacer ring 25 is also arranged between the trailing reel 15 and the rear wall 22.

In the present exemplary embodiment, the reels 12, 13, etc. are secured on the supporting frame 19 until the advance to the packaging machine. For this purpose, a tension member 27, in the present case a piece of rope, is drawn centrally through the reels 12, 13, etc. and anchored at the ends. To this effect, the tension member 27 is tied firmly in the rear wall 22 at one end. At the opposite free end, a threaded piece 28 is fastened to the tension member 27. A tensioning nut 29 is attached to the threaded piece 28 and brought to bear against a stay disc 30. This rests against the leading reel 12 or the core tube 24. As a result of an angular design of the edge of the stay disc 30, the latter partially penetrates positively into the core tube 24 and is thus centred. By means of the tensioning nut 29, the reels 12, 13, etc. can be braced relative to one another and relative to the rear wall 22 via the core tubes 24 and the spacer rings 25.

When a supporting frame 19 equipped with reels 12, 13, etc. is advanced in the packaging machine, in order to extract the reels 12, 13 the tensioning nut 29 has to be released and the tension member 27 drawn out of the region of the reels 12, 13.

Figure 5:
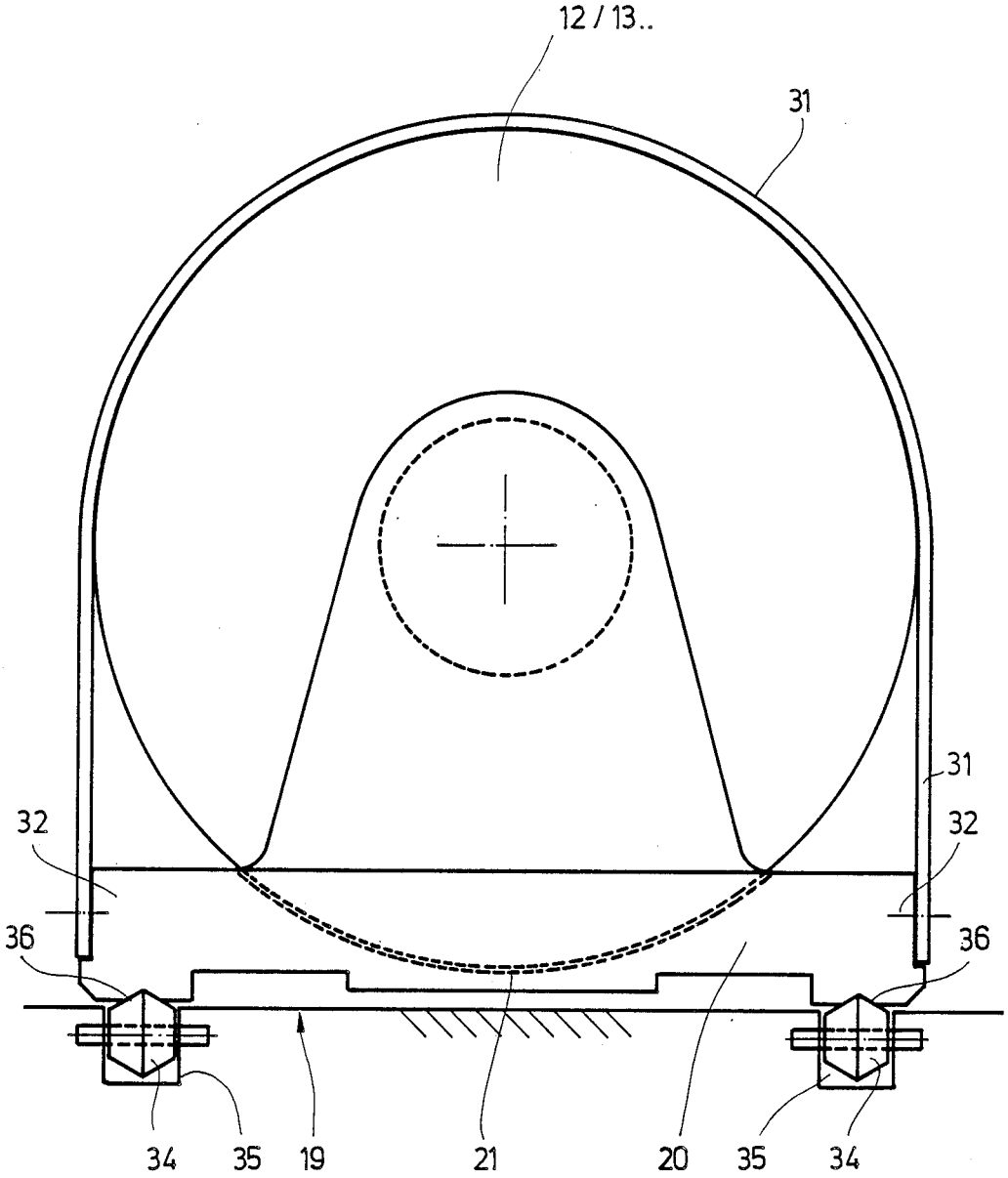
FIG. 5 shows a rear view of the detail according to FIG. 4.

In order to protect the reels 12, 13, etc. which consist of sensitive material, the supporting frame 19 is equipped with a cover 31. Here, this consists of a relatively thin wall made of elastically postforming material, for example sheet steel, plastic or the like. The cover 31 of hood-like shape is wrapped round the cylindrical outer surface of the reels 12, 13 in the upper and lateral regions and anchored respectively at the lower and lateral edges. As is evident especially from FIG. 5, the cover 31 is fastened releasably to the sides of the supporting frame 19 and to the baseplate 20 respectively. For this purpose, transversely projecting pegs 32 can be attached to the supporting frame 19 and enter bores 33 in the cover 31. After the advance of the supporting frame 19 to the packaging machine, the cover 31 is also removed before a first reel 12 is extracted.

Figure 3:
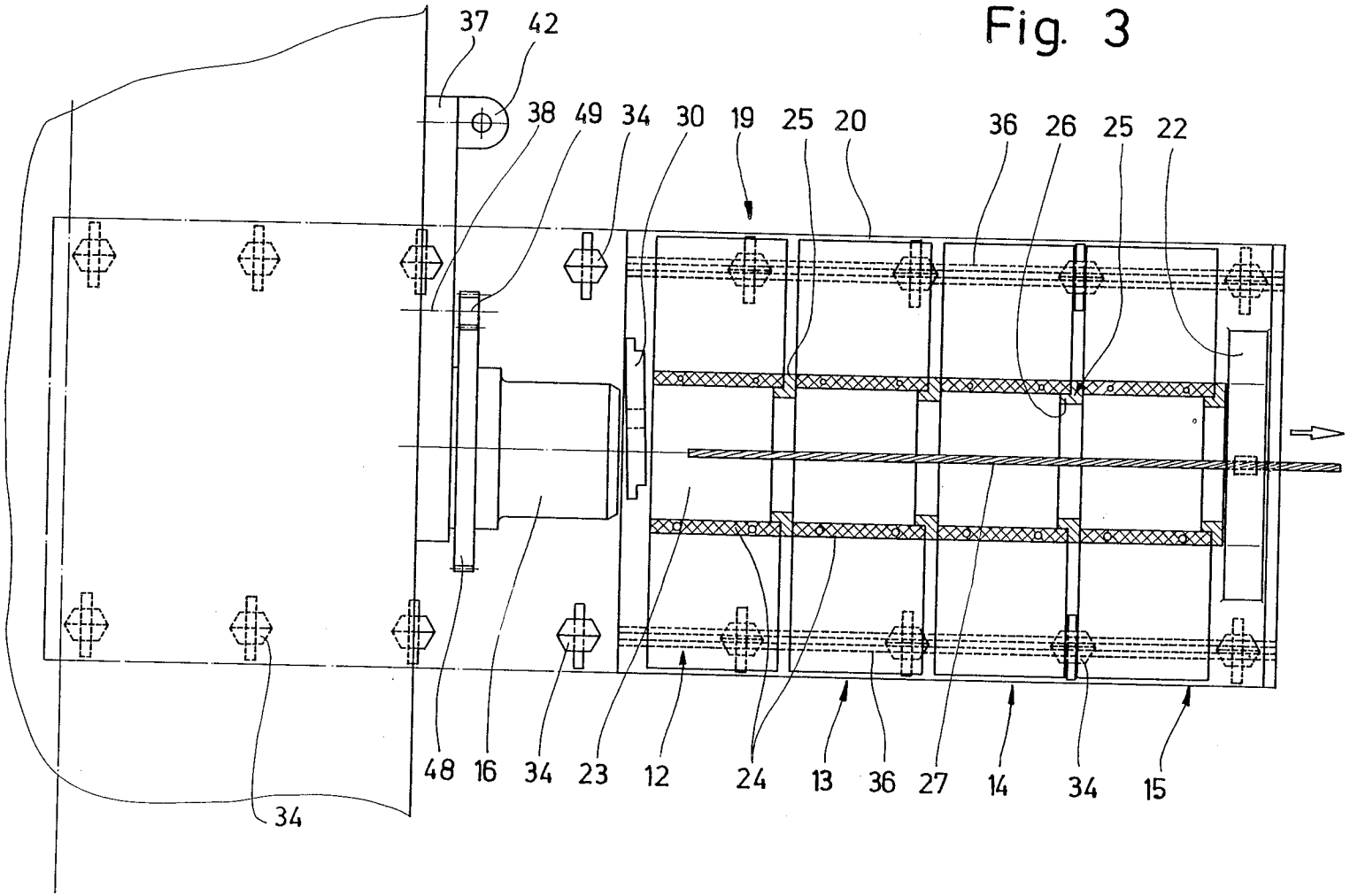
FIG. 3 shows a plan view of the detail according to FIG. 2, partially in horizontal section.
Figure 4:
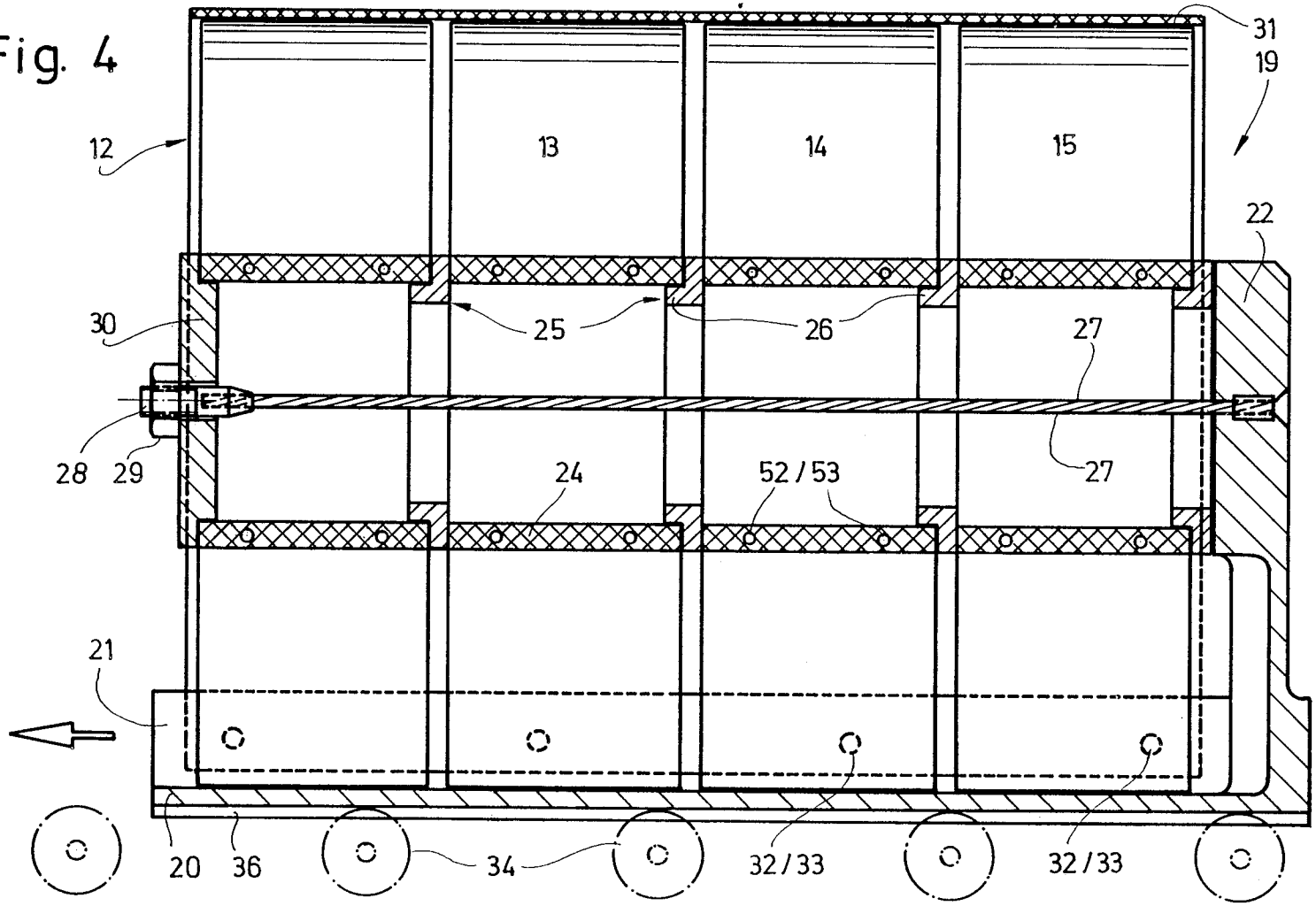
FIG. 4 shows a vertical section through a supporting frame for reels on a further-enlarged scale.

In the region of the packaging machine, the supporting frame 19 is movable on rollers. In the present exemplary embodiment, these are not attached to the supporting frame 19, but anchored in the floor. As illustrated, two rows of supporting rollers 34 are anchored at a fixed location and rotatably in the floor, specifically in a corresponding recess 35. The supporting rollers 34 are designed as shaped rollers, in particular with a roof-shaped profile. On the underside of the supporting frame 19, a correspondingly designed longitudinal groove 36 of triangular cross-section is provided respectively in the running region of the supporting rollers 34. In the conveying direction of the supporting frame 19, the successive supporting rollers 34 are at a distance from one another which guarantees that the supporting frame always rests on a relatively large number of supporting rollers 34. As is evident especially from FIG. 3, supporting rollers 34 extend right under the packaging machine, so that in the end position, in particular during the transfer of the last reel 15, the supporting frame 19 rests on supporting rollers 34 over its entire length.

Figure 6:
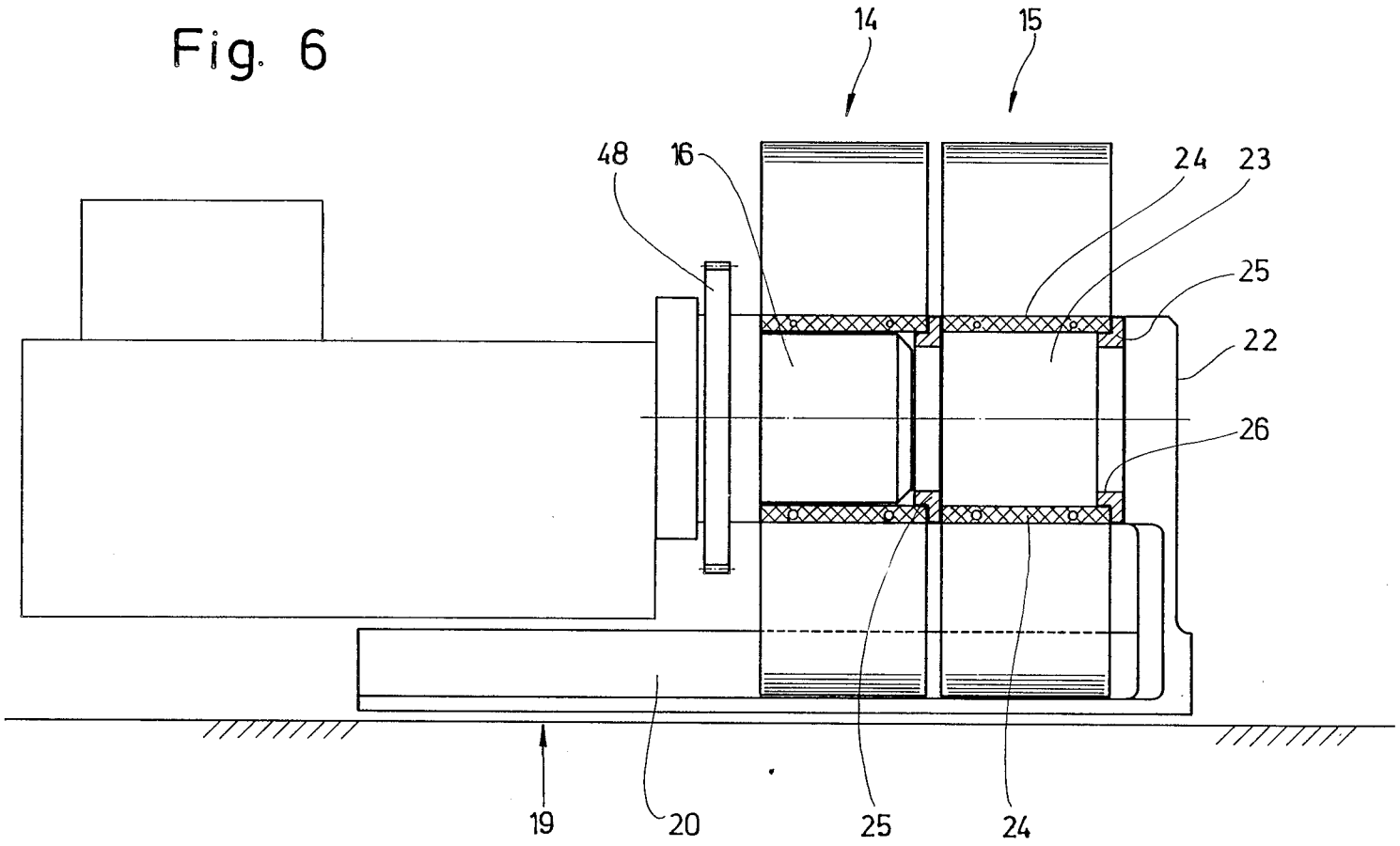
FIG. 6 shows a greatly simplified part of the packaging machine with a device for feeding the reels in a side view and in vertical section.
Figure 7:
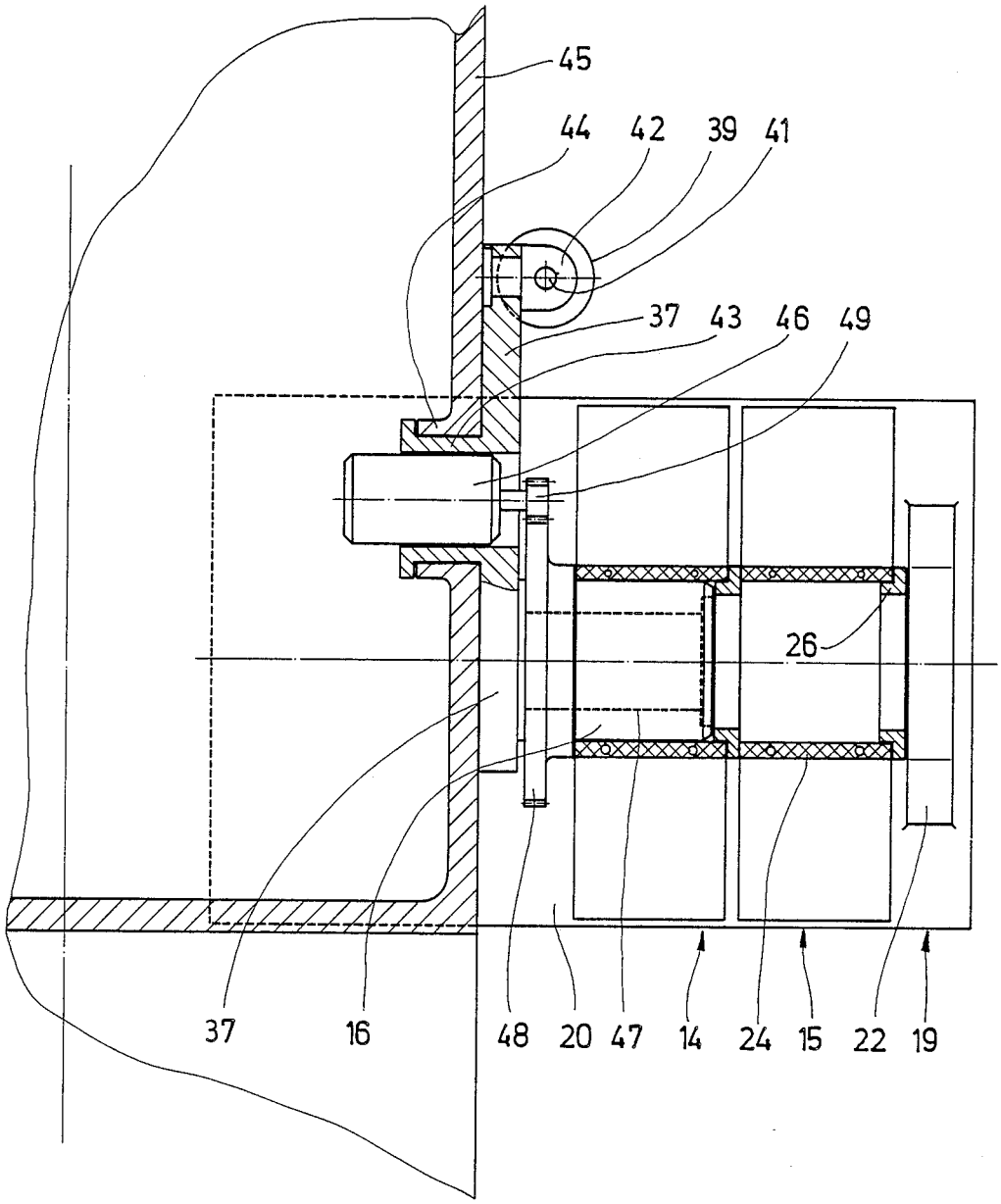
FIG. 7 shows a plan view and horizontal section in the region of the advance of the reels.
Figure 8:
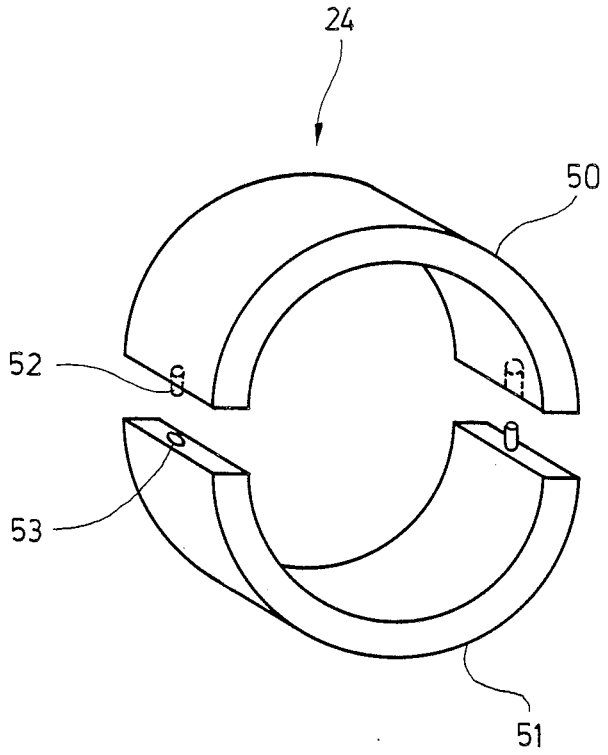
FIG. 8 shows a detail of a reel, particularly a core tube, in a perspective representation on an enlarged scale.

The supporting journal 16 can be moved up and down. In a lower position (FIG. 6 or the unbroken lines in FIG. 1), the supporting journal 16 extends equiaxially with the reels 12, 13, etc. The particular leading reel 12, 13, etc. can now be pushed onto the supporting journal 16 as a result of an advancing movement of the supporting frame 19.

Figure 2:
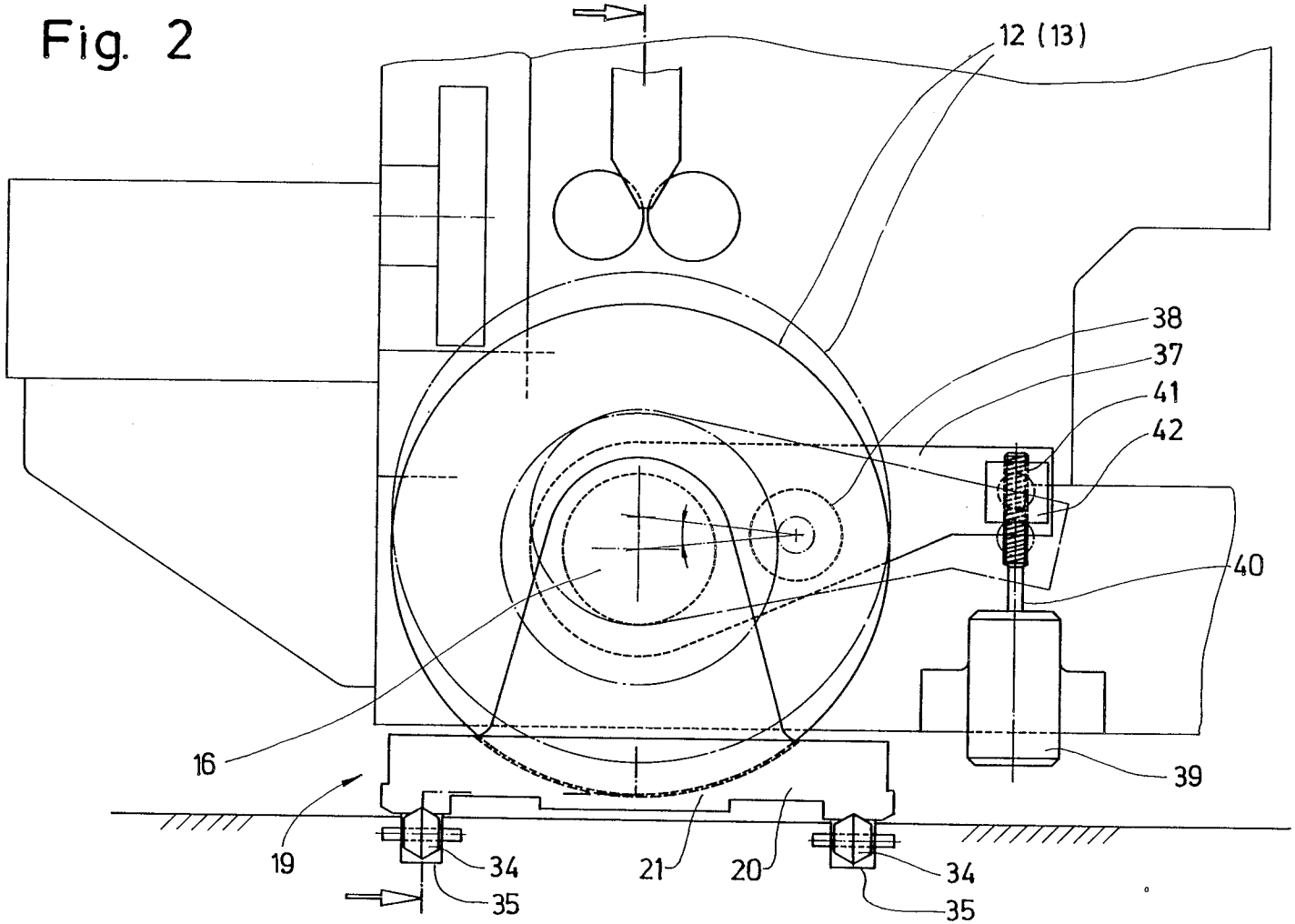
FIG. 2 shows a rear view of the packaging machine according to FIG. 1 on an enlarged scale.

The supporting journal 16 together with the particular working reel is thereafter moved upwards into an upper working position (dot-and-dash lines in FIG. 2). In this position, the material web 10 is drawn off from the working reel 12, 13, etc. and processed in order to form blanks 11.

In order to execute the up-and-down movements, in the present example the supporting journal 16 is mounted on a pivotable two-armed supporting arm 37. The supporting arm 37 is pivotable through a small angle about a pivot bearing 38. For the corresponding drive of the supporting arm 37, a motor 39 of reversable driving direction is mounted on the packaging machine. A vertical drive shaft 40 is designed in the upper region as a spindle 41. This is in engagement with a spindle nut 42 on the free end of the supporting arm 37.

In the present exemplary embodiment, the pivot bearing 38 is designed in a special way. The supporting arm 37 is equipped with a cylindrical bearing flange 43 which is supported rotatably on a likewise cylindrical counterflange 44 of the packaging machine or of a machine cheek 45 of the latter. The bearing flange 43 in turn receives centrally a drive motor 46 which is attached fixedly to the packaging machine and which drives the supporting journal 16, in order to make it easier to draw off the material web 10 from the particular working reel. The supporting arm 37 is accordingly pivotable about the drive motor 46.

The rotatable supporting journal 16 is mounted on a fixed carrier bolt 47 and adjacent to the supporting arm 37 is equipped with a gear wheel 48. This is in engagement with a pinion 49 of the drive motor 46. The supporting journal 16 can thus be driven despite its movability in the upward direction without a coupling or any other members for drive transmission.

In the present case, a further special feature is the design of the core tube 24. This is subdivided in the longitudinal direction and consists of several, in this particular case two semi-cylindrical part tubes 50, 51. The two part tubes 50, 51 are connected releasably to one another, in the present example via pegs 52 and bores 53, in the region of the radially directed joining faces, in order to form the closed core tube 24.

Because of the divided design of the core tube 24, it becomes easier to eliminate it after a working reel 12, 13, etc. has run empty. The core tube 24 does not have to be drawn off from the supporting journal 16 in the axial direction, but can be drawn off — by hand — in the transverse direction.

What is claimed is:

1. Packaging machine, for the production of cigarette packs, in which pack blanks (11) are severed from a material web (10), wound as a reel (12), and are processed, and in which one reel (12) at a time is received on a rotatable horizontal supporting journal (16); said machine comprising:

a supporting frame (19) for supporting several reels (12, 13, 14, 15) equiaxially next to one another and being horizontally movable in the direction of said supporting journal (16) to feed said reels (12...15) in succession to said supporting journal (16) to allow the leading reel (12) to be attached to said supporting journal (16);

a plurality of supporting rollers (34) which are fixed in location and which determine a horizontal path of movement of the supporting frame (19);

said supporting frame (19) having guiding grooves (36), each of which has a cross-section corresponding to that of said supporting rollers and which receive said supporting rollers with a positive fit; and means for vertically adjusting said supporting journal (16) between a lower position for receiving a reel (12...15) and an upper working position, said supporting journal being oriented coaxially relative to the equiaxially arranged reels (12...15) in said lower position.

2. Packaging machine according to claim 1, wherein said supporting rollers are embedded in a floor, and the guiding grooves (36) are located on the underside of the supporting frame (19).

3. Packaging machine according to claim 1 or 2, wherein the supporting frame (19) comprises a baseplate (20) having a storage trough (21), for the positive mounting of the reels (12...15) arranged equiaxially next to one another, and also having an end stop in the form of a rear wall 22.

4. Packaging machine according to claim 3, comprising tension member means (27) for releasably anchoring the reels (12...15) on the supporting frame (19), said tension member means extending centrally through said reels (12...15) and being anchored under bracing stress at opposite ends thereof.

5. Packaging machine according to claim 4, further comprising means for respectively releasably anchoring the tension member (27) at one end on said rear wall (22) and at the other end in a stay disc (30) resting against the leading reel (12).

6. Packaging machine according to claim 4, further comprising an elongated core tube (24) on which the reels (12, 13, etc.) are wound, said core tube (24) being divided in the longitudinal direction to form two semi-cylindrical partial tubes (50, 51), and a releasable plug connection for connecting the partial tubes to one another.

7. Packaging machine according to claim 1, further comprising core tubes (25) on which the reels are wound, and spacing rings (25) having an angular cross-section and supporting the reels (12...15) relative to one another on the supporting frame (19), said spacing rings being supported on said core tubes (24) of adjacent reels (12...15).

8. Packaging machine according to claim 1, wherein the supporting frame (19) has a front region which becomes free in proportion as reels (12...15) are extracted and which is movable under said packaging machine.

9. Packaging machine according to claim 1, wherein the supporting frame (19) comprises a releasable cover (31) which surrounds the reels (12...15) in an upper free region thereof and which consists of a postforming thin wall made of sheet steel or plastic.

10. Packaging machine according to claim 1, further comprising a pivotable supporting arm (37), on which the supporting journal (16) is mounted, for vertically adjusting the supporting journal (16).

11. Packaging machine according to claim 10, wherein the supporting arm (37) is a two-armed supporting arm, and further comprising drive means, including a motor (39), a spindle (41) and a spindle nut (42) at the end of the supporting arm (37), for pivoting the supporting arm in both directions.

12. Packaging machine according to claim 10, wherein said supporting arm has a pivot bearing (38), and further comprising drive means for driving the supporting journal (16) and comprising a drive motor (46), mounted at a fixed location in the pivot bearing (38) of the supporting arm (37), a gear wheel (48) and a pinion (49).

13. Packaging machine, for the production of cigarette packs, in which pack blanks are severed from a material web wound as a reel and are processed, one reel at a time being received on a rotatable supporting journal, said machine comprising:

a supporting frame (19) for supporting several reels (12, 13, 14, 15), arranged equiaxially next to one another, and for feeding the reels in succession to the supporting journal (16) so that the leading reel (12) is attached to the supporting journal (16);

a pivotable supporting arm (37), on which said supporting journal (16) is mounted, for vertically adjusting said journal (16) between a lower position for receiving a reel (12, 13, etc.) and an upper working position, said supporting arm having a pivot bearing (38); and drive means for driving the supporting journal (16) and comprising a drive motor (46), mounted at a fixed location in the pivot bearing (38) of the supporting arm (37), a gear wheel (48) and a pinion (49).

14. Packaging machine, for the production of cigarette packs, in which pack blanks are severed from a material web wound as a reel and are processed, one reel at a time being received on a rotatable supporting journal, said machine comprising:

a supporting frame (19) for supporting several reels (12, 13, 14, 15), arranged equiaxially next to one another, and for feeding the reels in succession to the supporting journal (16) so that the leading reel (12) is attached to the supporting journal (16);

supporting rollers (34) disposed at a fixed location and embedded in a floor, an underside of said supporting frame having longitudinal grooves (36) which are shaped to receive said supporting rollers (34) and into which said supporting rollers (34) penetrate, said supporting frame (19) being movable on said supporting rollers (34);

said supporting frame (19) comprising a base plate (20) having a storage trough (21), for positively mounting the reels (12, 13, etc.) equiaxially next to one another, and also having an end stop in the form of a rear wall (22); and a tension (27), adapted to be guided centrally through the reels (12, 13, etc.), for releasably anchoring the reels on said supporting frame (19), and means for anchoring opposite ends of said tension member (27) under bracing stress.

15. Packaging machine according to claim 14, wherein the tension member (27) is respectively anchored releasably at one end on the rear wall (22) and at the other end in a stay disc (30) resting against the leading reel (12).

16. Packaging machine according to claim 14, further comprising an elongated core tube (24) on which the reels (12, 13, etc.) are wound, said core tube (24) being divided in the longitudinal direction to form two semicylindrical partial tubes (50, 51), and a releasable plug connection for connecting the partial tubes to one another.

* * * * *